United States Patent [19]

Feuvray

[11] 4,248,001

[45] Feb. 3, 1981

[54] PORTABLE SIGN DISPLAY DEVICE

[76] Inventor: Alain Feuvray, 3 rue du Palais de justice, 71100 Chalon sur Saone, France

[21] Appl. No.: 959,193

[22] Filed: Nov. 7, 1978

[30] Foreign Application Priority Data

Nov. 22, 1977 [CH] Switzerland ..... 14257/77

[51] Int. Cl.[3] ..... G09F 7/00

[52] U.S. Cl. ..... 40/602; 40/606

[58] Field of Search ..... 40/602, 606, 613, 584; 116/63 P

[56] References Cited

U.S. PATENT DOCUMENTS

| | | | |
|---|---|---|---|
| 1,750,118 | 3/1930 | Mueller | 40/602 |
| 1,983,174 | 12/1934 | Joerger | 40/613 |
| 2,054,230 | 9/1936 | Patterson | 40/613 |
| 3,521,390 | 7/1970 | Carlsom | 40/602 |
| 3,719,000 | 3/1973 | Finger | 40/602 |
| 4,113,216 | 9/1978 | Fuse et al. | 40/602 |

FOREIGN PATENT DOCUMENTS

| | | | |
|---|---|---|---|
| 835082 | 5/1960 | United Kingdom | 40/584 |
| 1117283 | 6/1968 | United Kingdom | 40/610 |
| 1311582 | 3/1973 | United Kingdom | 40/607 |
| 1428971 | 3/1976 | United Kingdom | 40/612 |

*Primary Examiner*—Gene Mancene
*Assistant Examiner*—Wenceslao J. Contreras
*Attorney, Agent, or Firm*—Young & Thompson

[57] ABSTRACT

Two supporting elements of a stand for a display panel can either be opened-out and placed on the ground in the service position or folded-back when not in use. The ends of the two supporting elements are associated with a pivot on each side of the panel which is thus capable of rotating about a horizontal axis. Springs permit angular displacement of the panel to a horizontal position and serve to return the panel to a substantially vertical rest position. Potential applications of the device include portable traffic signs and advertising panels.

5 Claims, 12 Drawing Figures

FIG. 7
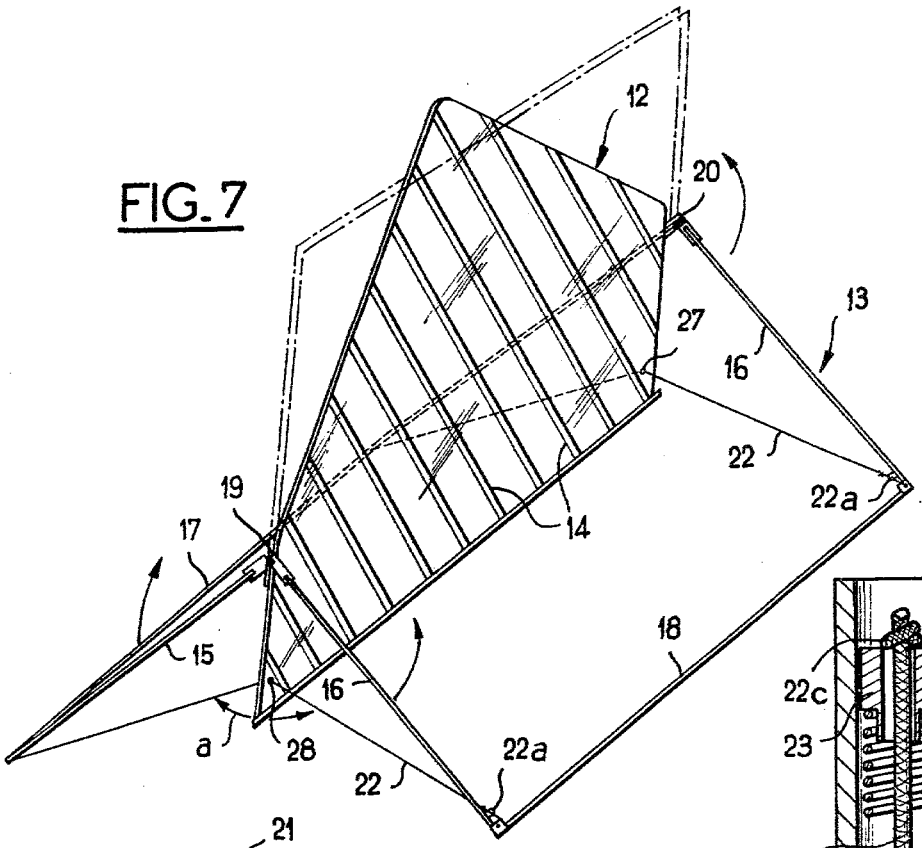
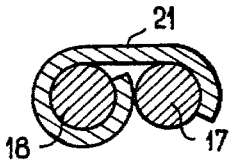
FIG. 10
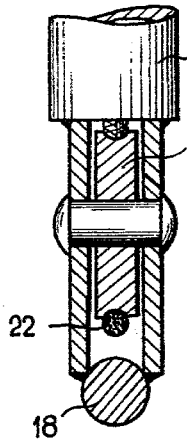
FIG. 9
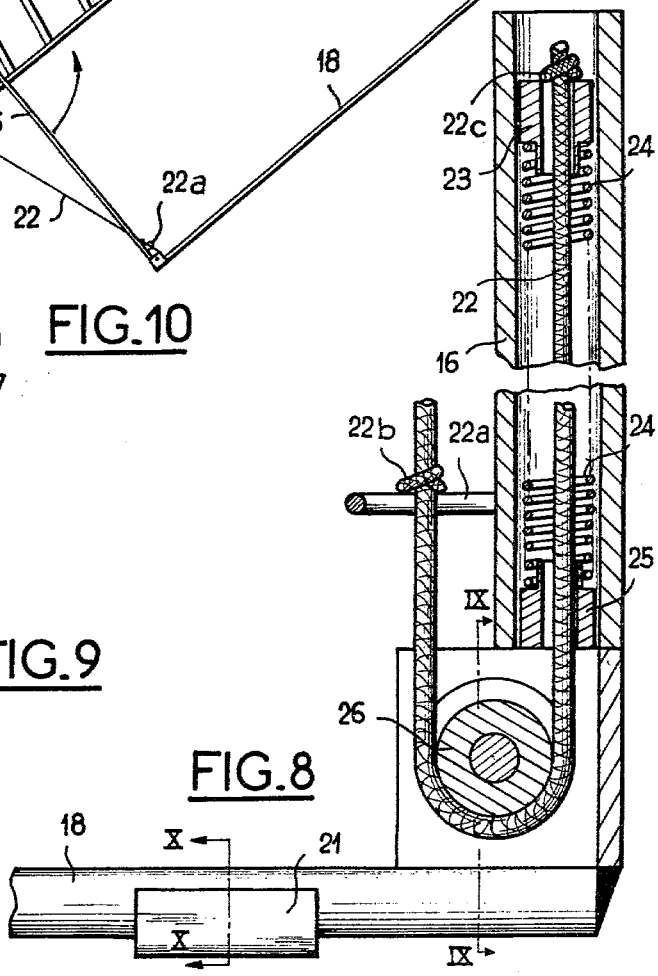
FIG. 8

PORTABLE SIGN DISPLAY DEVICE

This invention relates to a portable sign display device for different purposes.

Many devices of this type are already known. A typical design consists of an indicator panel mounted vertically on a stand which is intended to rest on the ground in the service position, for example at the edge of a roadway.

Display devices such as road signs of the known type just mentioned are attended by a number of disadvantages. Especially in the case of panels of large size, they are relatively heavy as well as costly in the long term. In addition to the difficulties of transportation and erection, the substantial weight of known devices tends to aggravate the consequences of impact of any vehicle which strikes the panel accidentally as it passes.

Furthermore, known sign display devices often have insufficient stability in spite of impractical weighting means such as pig-iron blocks or sandbags. Such means are intended to afford resistance to wind which is always liable to overturn a road-sign panel, thus making it both invisible and hazardous for road users as they pass in the vicinity of the panel.

The aim of the invention is to permit the construction of a movable, lightweight and economical sign display device which does not entail the need for any weighting, which can readily be transported and placed in position, and which also has satisfactory stability in the service position, especially with a view to affording resistance to wind action.

The invention is directed to a portable sign display device, especially for road traffic and comprising an indicator panel mounted on a stand which is placed on the ground in the service position.

In accordance with the invention, a distinctive feature of the aforementioned device lies in the fact that the stand is made up of two similar U-shaped supporting elements each having a base member and two arms located transversely with respect to the base member; the two supporting elements can be folded-back one against the other in the transportation position and can be opened-out in the service position aforesaid; one extremity of each arm of a supporting element is associated by means of a pivot with one extremity of one arm of the other supporting element; the two pivots of the arms of the supporting elements of the stand determine a substantially horizontal axis in the vicinity of the plane of the panel in the service position, thus constituting an axis of oscillating motion for the panel which is rotatably mounted by means of two opposite portions of its edge on the two articulations of the arm extremities; means are provided for permitting angular displacement of the panel to the horizontal and for returning the panel to a rest position which is substantially vertical or inclined if necessary.

By giving the arms of the stand a sufficient length and suitable angular spacing in the service position, the device can accordingly be endowed with a high degree of stability. By permitting oscillating motion of the panel about the horizontal axis of the stand pivots, the overturning action of wind or other air displacements can be reduced to a very considerable extent as will be explained below.

Preferably, each articulation of the extremities of the arms of the stand is provided with two coaxial sleeves which are rigidly fixed to the arms and are horizontal in the service position. One of the sleeves has a tubular end portion of reduced thickness which is engaged within the other sleeve and forms therein a pivot for the swinging movement of the arms. The adjacent edge of the panel is rigidly fixed to a hub having an extension in the form of a cylindrical rod which is engaged within the tubular end portion aforesaid and forms therein a pivot for the oscillating motion of the panel.

As will hereinafter be explained in greater detail, these arrangements permit of economical and rugged industrial construction of the device.

In the case of a substantially circular panel, for example, the axis of oscillating motion of the panel is advantageously located below the center of the panel at a distance substantially equal to one-half the radius of said panel. The device further comprises two springs for producing a restoring action on the panel on each side of this latter. One end of each spring is attached to the edge of the panel below the axis of oscillating motion and the other end is attached to one arm of one of the supporting elements of the articulated stand. The length of each spring is such that this latter is in slight tension in the position of relative outward displacement of the supporting elements of the stand.

Thus the panel is capable of free inclination under the action of strong gusts of wind without imparting an excessive reaction to the stand. The springs return the panel elastically to the service position which is substantially vertical or which may be inclined if so desired.

Further distinctive features and advantages of the invention will be brought out by the following description of a preferred embodiment which will be presented hereinafter by way of example and not in any limiting sense, reference being made to the accompanying drawings, wherein:

FIG. 7 is a view in perspective showing an alternative embodiment of the sign display device in accordance with the invention;

FIG. 8 is a fragmentary sectional view of a supporting element of the device in accordance with the invention;

FIG. 9 is a sectional view taken along the plane IX—IX of FIG. 8;

FIG. 10 is a sectional view taken along the plane X—X of FIG. 8;

Figure 1:
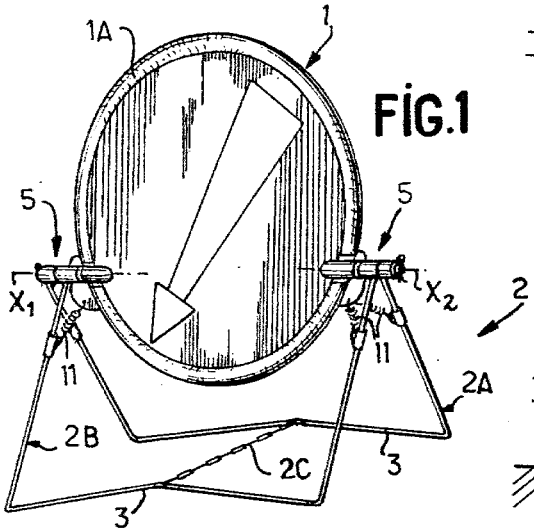
FIG. 1 is a general view in perspective showing a sign display device in accordance with the invention and in the service position.
Figure 3:
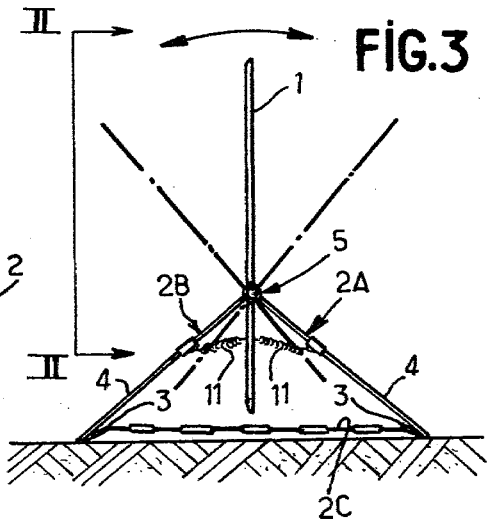
FIG. 3 is a side view of the same device.
Figure 2:
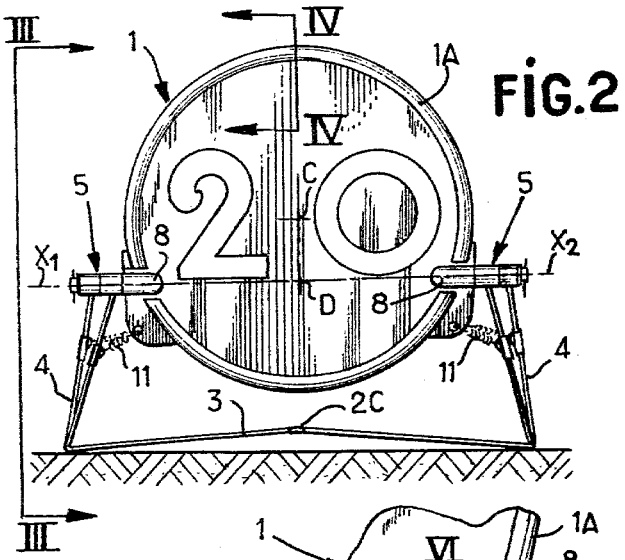
FIG. 2 is a front view of the device of FIG. 1.

In the embodiment of FIGS. 1 to 3, the portable and movable sign display device is designed primarily for road traffic control or service. The device comprises an indicator panel 1 which may be circular, for example, and has a standardized diameter of the order of 1 meter.

Figure 4:
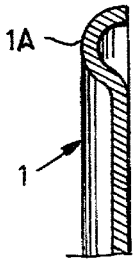
FIG. 4 is a sectional view of the edge of the panel, this view being taken along line IV—IV of FIG. 2.

The panel 1 is mounted vertically on a stand 2 which is adapted to be placed directly on the ground in the service position and next to a roadway. The panel 1 is formed of cut-out metal and preferably provided with an edge 1A having a cambered profile formed by die-stamping in order to ensure stiffness of the panel (as shown in FIG. 4). The indicator panel 1 can exhibit various signs of suitable types, for example for road traffic service. Said panel can be coated with luminescent paint or with any other product such as an adhesive.

In accordance with the invention, the stand 2 is made up of two identical U-shaped supporting elements 2A, 2B each having a base member 3 which is of slightly greater lengths, for example, than the diameter of the panel 1, and two arms 4 of equal length which are located transversely with respect to the base member 3. The two supporting elements 2A, 2B which are formed, for example, of steel tubing having an internal diameter of 8×13 mm can be folded-back against each other to render the device compact for transportation and can be opened-out in the service position. Preferably and as shown in FIG. 3, the relative outward displacement of the two supporting elements 2A, 2B of the stand is approximately equal to 90° in order to ensure excellent stability of the device as will be explained below.

In order to limit the extent of relative outward displacement of the two supporting elements 2A, 2B to the value indicated, a small chain 2C (as shown in FIG. 3) is employed by way of example. Each end of the chain is attached to the base member 3 of one of the supporting elements 2A, 2B.

One extremity of each arm 4 of a supporting element such as the element 2A is associated by means of a pivot 5 with one extremity of one arm of the other supporting element 2B. In the service position of the device, the two pivots 5 of the arms 4 of the supporting elements 2A, 2B of the stand determine an axis X1-X2 which is substantially horizontal and adjacent to the plane of the panel 1. The axis X1-X2 constitutes an axis of oscillating motion for the panel 1 which is rotatably mounted by means of two opposite portions of its edge 1A on the two articulations 5 of the extremities of the arms 4.

Means described hereinafter are provided for permitting angular displacement of the panel 1 to the horizontal about its axis of oscillation X1-X2 and in order to return the panel 1 to a substantially vertical rest position as shown in FIG. 3.

Figure 5:
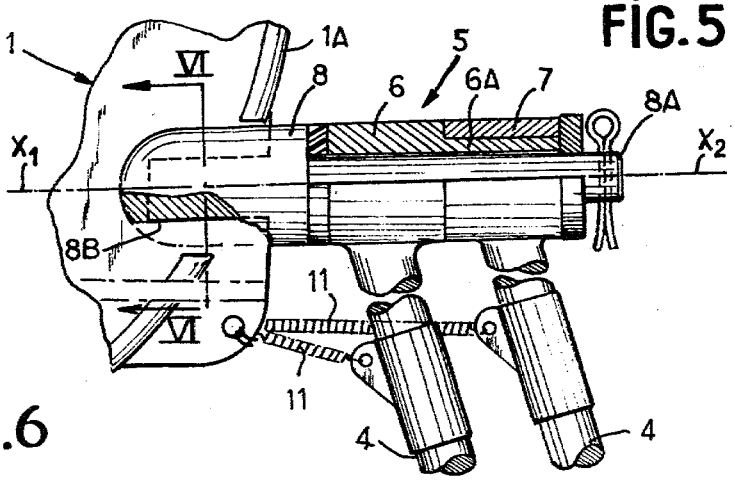
FIG. 5 is an enlarged detail view of the right-hand side of FIG. 2 and showing the pivot of the two arms of the stand, this pivot being associated with a pivotal-motion panel mounting.

Preferably, each pivot 5 of the extremities of the associated arms 4 of the stand 2 (as shown in FIG. 5) is provided with two coaxial sleeves 6, 7 which are attached in each case to one of the arms 4 and located horizontally in the service position along the axis X1-X2. One of the sleeves such as the sleeve 6 has a tubular end portion 6A of reduced thickness which is engaged in the other sleeve 7 and forms in sleeve 7 a pivot for the two supporting elements 2A, 2B of the stand. The adjacent edge 1A of the panel 1 is rigidly fixed to a hub 8 having an extension in the form of a cylindrical rod 8A. Said rod is engaged in the tubular portion 6A of the sleeve 6 and forms in this latter a pivot for the oscillation of the panel 1 about the axis X1-X2.

Figure 6:
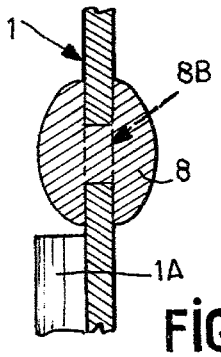
FIG. 6 is a sectional view of the hub for mounting the panel of FIG. 5, this view being taken along line VI—VI.

In accordance with an advantageous arrangement shown in FIGS. 5 and 6, the hub 8 is engaged in a horizontal slot 8B of the edge 1A of the panel and maintained in position by virtue of the elasticity of the stand arms 4 which is exerted in the opposite direction along the axis X1-X2 on the two opposite hubs 8 which correspond in each case to one of the pivots 5.

In the case of a circular panel 1 as illustrated in FIG. 2, the axis X1-X2 of oscillating motion defined by the two pivots 5 advantageously passes below the center C of the panel 1 at a distance CD which is substantially equal to one-half the radius of the circular panel 1.

In order to ensure that the panel 1 is maintained elastically in a substantially vertical service position (as shown in FIG. 3), the device comprises two springs 11 on each side of the panel. One extremity of each spring 11 is attached to the edge 1A of the panel beneath the axis of oscillation X1-X2 whilst the other extremity is attached to one arm 4 of one of the supporting elements 2A, 2B of the stand 2 (as shown in FIG. 5). The length of each spring 11 is such that this latter is in slight tension in the position of relative outward displacement of the supporting elements 2A, 2B of the stand.

The use and operation of the sign display device which has just been described will now be explained with reference to FIGS. 1 to 6.

In order to put the sign display device into service, starting from the initial folded position of the stand in which the two supporting elements 2A, 2B are folded-back against each other, it is necessary only to place the stand on the ground after having opened-out said supporting elements to a value of angular displacement which is limited by the small chain 2C. In order to ensure excellent stability of the stand, this angular displacement is preferably equal to approximately 90° (as shown in FIG. 3).

The relative outward displacement of the two supporting elements 2A, 2B of the stand results in slight tensioning of the springs 11, the length of which is accordingly determined by design. The panel 1 is thus maintained elastically in a substantially vertical rest position and is free to oscillate about the horizontal axis X1-X2 determined by the rods 8A of the fixing hubs 8.

Under the action of wind, a horizontal force is developed in a transverse direction with respect to the panel and applied to the center of this latter, with the result that the panel moves freely away from its vertical rest position towards the horizontal. Irregularities in wind velocity have the effect of modifying the angle of inclination of the panel 1 which is restored to its vertical rest position by the springs 11 (as shown in FIG. 3). The horizontal force imparted to the stand 2 is accordingly reduced by the inclination of the panel.

Furthermore, by virtue of the value of angular spacing of its supporting elements 2A, 2B which is equal to approximately 90°, the stand has excellent stability for affording resistance to overturning forces produced by wind. Moreover, the pressure of air on the panel increases the pressure applied to the ground and the depression (contrary effect of the wind) is counteracted by the automatic return of the panel to its rest position without any accompanying displacement of the stand. Weighting either of the stand or of the panel is consequently unnecessary.

It is also worthy of note that the presence of the panel 1 and the indications marked thereon are made more conspicuous by the movements of oscillation of said panel about its horizontal axis X1-X2 under the action of strong gusts of wind. The luminescent paint with which the panel is preferably coated increases the effects of light contrast resulting from the above-mentioned movements of oscillation.

As has become apparent from the foregoing, the sign display device in accordance with the invention offers a number of important advantages over known devices.

The device is light, convenient to manufacture on an industrial scale and easy to handle.

As a result of tilting of the panel about its horizontal axis, overturning forces exerted on the device under the action of wind are reduced to a considerable extent. Moreover, the stand is highly stable in the opened-out position of its articulated supporting elements.

The oscillating or swinging movements of the panel under the action of wind have the effect of attracting attention in a very effective manner by producing alternate luminous effects.

In the event of sudden impact of a vehicle which accidentally strikes the panel, the extent of damage is of a very low order by reason of the light weight of the device.

In the folded-back position, the device can readily be stored and transported by reason of its lightweight design and its small volume.

As can readily be understood, the invention is not limited to the embodiment described in the foregoing by way of example and a number of alternative forms of construction can accordingly be contemplated without thereby departing from the scope of the invention.

In the alternative embodiment shown in FIGS. 7 to 10, the portable sign display device comprises an indicator panel 12 having the shape of a pentagon. Said panel 12 is mounted vertically on a stand 13 which is placed on the ground. In this example, the panel 12 is provided with oblique bracing members 14. Said panel 12 can carry various types of signs for directing traffic, for display or for advertising purposes.

The stand 13 is constituted by two pairs of tubular arms 15, 16 which are joined together at their lower ends by means of cross-members 17, 18. The tubular arms 15, 16 are provided at the ends opposite to the cross-members 17, 18 with articulations 19 and 20 which support the panel 12.

In the service position, the tubular arms 15, 16 are placed at an angle of approximately 90° with respect to each other. This position is maintained by means of a locking system which will be described in greater detail below.

In the storage position, the tubular members 15, 16 and cross-members 17, 18 are folded-back towards the panel 12 in a movement of rotation about the pivots 19, 20 (see the position shown in chain-dotted lines in FIG. 7). In this storage position, the cross-members 17 and 18 are locked one against the other by means of one or a number of hooks 21 fixed on one of the cross-members (see FIG. 8), these hooks 21 being engaged on the other cross-member as shown in FIG. 10.

In FIG. 8, it can be seen that each tubular arm 16 or 15 contains a cable 22 and the free end **22*c* of said cable is secured to a piston 23 which is capable of displacement within the tubular arm 16 or 15 in opposition to the action of a spring 24. Said spring 24 is applied at the lower end of the tubular arm 16 against a stop 25 through which the cable 22 passes. Said cable 22 surrounds a pulley 26 and is returned by this latter to the points 27 and 28 of the panel 12. The cable is attached to the panel at said points, then passes from these latter to the other pulleys which are secured to the lower ends of the tubular arms 15 which are located on the other side of the panel 12**.

Thus, when the base of the panel 12 moves towards the tubular arm 15 under the action of a thrust exerted by the wind, for example, the cable 22 which is attached at the point 28 becomes taut while slackening of the cable located on the other side takes place at the same time.

Provision is also made in the vicinity of each pulley 26 for an eyed lug **22*a* which is rigidly fixed to each arm 15 or 16 and through which the cable 22 passes. A knot 22*b* or the like formed in the cable 22 prevents displacement of this latter towards the pulley 26**.

Under the action of wind, for example, the panel 12 is capable of swinging from the vertical position; in one direction, the cable 22 has the effect of compressing the spring 24 which is housed within one of the tubular arms and of releasing the spring which is housed within the other tubular arm.

Furthermore, the fact that the springs 24 are entirely housed within the tubular arms 15 and 16 achieves a considerable improvement in the appearance and reliability of the complete unit, facilitates folding-back of the tubular arms 15 and 16 and reduces overall size for storage and transportation.

Figure 11:
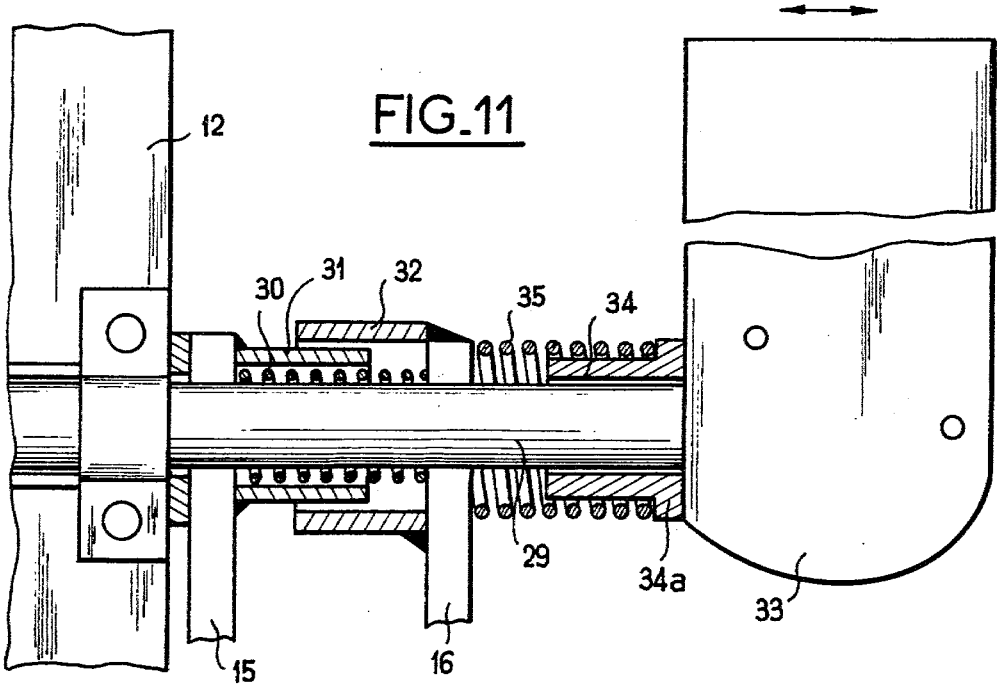
FIG. 11 is a fragmentary sectional view of one of the pivots of the panel with respect to the stand.
Figure 12:
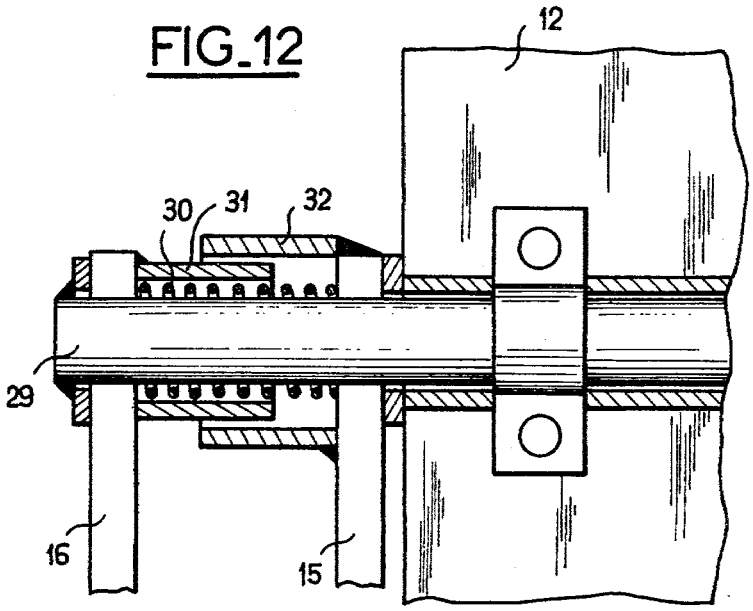
FIG. 12 is a view which is similar to that of FIG. 11 and shows the other pivot.

FIGS. 11 and 12 show that the end portions of the arms 15 and 16 of the stand 13 are mounted on a shaft 29.

There is inserted between the end portions of the arms 15 and 16 a spring 30 which maintains a predetermined spacing between said arms 15 and 16. It is also shown that the spring 30 is surrounded by two square-section sleeves 31, 32 which are engaged one over the other. In this position, the square-section sleeves 31, 32 prevent relative rotation of the arms 15, 16 and thus lock these latter in the service position.

It is further apparent from FIG. 11 that the shaft 29 is extended on one side of the panel 12 to a certain distance beyond the arm 16. The free extremity of said shaft 29 is adapted to carry a handle 33. Provision is made between said handle 33 and the member 16 for a ring 34 provided with an annular flange **34*a* which constitutes a stop for a spring 35 placed between the member 16 and the handle 33. The spring 35 is more powerful than the spring 30. The handle 33 is mounted astride the shaft 29 and capable of pivotal displacement on this latter while compressing the spring 35. Said handle 33** forms a cam and is eccentrically mounted on a small shaft (not shown in the figure).

The operation of this device takes place as follows:

in the storage position, the handle 33 is unlocked and thrust back towards the exterior of the panel 12 under the action of the springs 30 and 35. In this position also, the square-section sleeves 31, 32 are disengaged from each other, with the result that the arms 15 and 16 are capable of rotating freely on the shaft 29;

in the service position, the arms 15 and 16 are brought into position at an angle of approximately 90° with respect to each other; in this position, the sleeves 31 and 32 can be engaged one within the other by pivotally displacing the handle 33 towards the panel 12. This is possible by virtue of the fact that the spring 35 is more powerful than the spring 30. At the end of travel, the handle 33 is locked with respect to the shaft 29 in a manner known per se, with the result that the arms 15 and 16 are locked in position with respect to each other.

I claim:

1. In a portable sign display device comprising an indicator panel mounted on a stand to be placed on the ground in a service position, the stand comprising two similar U-shaped supporting elements each having a base member and two arms of equal length located transversely with respect to said base member, the sign display device comprising pivotal means for pivotally interconnecting one extremity of each arm of a supporting element with one extremity of one arm of the other supporting element and with the indicator panel, the pivotal means defining a substantially horizontal axis in the vicinity of the panel when the device is placed on the ground in the service position; the improvement in which at least one pair of pivotally associated arms are tubular and contain each a piston, a stop, and a spring inserted between said piston and said stop, the device also comprising cable means attached to the panel and having one end located inside the bottom portion of one tubular arm of said pair and attached to the piston of said arm and another end located inside the bottom portion of the other tubular arm of said pair and attached to the piston of the last-named arm.

2. A portable sign display device according to claim 1, wherein said device comprises a guide pulley mounted in the lower portion of each tubular arm of said pair, said cable being engaged on said pulleys.

3. A portable sign display device according to claim 1, wherein in a folded position, the base members lie against the top of the panel.

4. A portable sign display device according to claim 2, wherein the end portions of the tubular arms adjacent to the pivotal means carry means for locking said arms with respect to each other in the service position in which the U-shaped supporting elements are angularly spaced and disposed each on one side of the base of the panel, said means comprising two square-section sleeves separated by a spring and engageable one within the other when the supporting elements are in service position, these sleeves being secured each to one arm of a pair of pivotally associated arms, the pivotal means comprising a shaft which is surrounded by said sleeves, and means for engaging said sleeves one within the other against the action of the last-named spring.

5. A portable sign display device according to claim 4, wherein the means for engaging said sleeves one within the other comprises a handle eccentrically mounted at the free extremity of the shaft and separated from the sleeves by another spring which is more powerful than the spring which separates the sleeves from each other.

* * * * *